United States Patent [19]

Somekh et al.

[11] 4,346,015

[45] Aug. 24, 1982

[54] METHOD OF IMPROVING ANTIWEAR PROPERTIES OF HIGH TEMPERATURE HYDROCARBON COMPOSITIONS

[75] Inventors: George S. Somekh, New Rochelle, N.Y.; Robert A. Cupper, Ridgefield, Conn.

[73] Assignee: Union Carbide Corporation, Danbury, Conn.

[21] Appl. No.: 177,909

[22] Filed: Aug. 14, 1980

Related U.S. Application Data

[63] Continuation of Ser. No. 13,535, Feb. 21, 1979, abandoned.

[51] Int. Cl.[3] ..... C10M 1/32

[52] U.S. Cl. ..... 252/50; 252/52 R; 252/390; 252/392

[58] Field of Search ..... 252/50, 52 R, 390, 393

[56] References Cited

U.S. PATENT DOCUMENTS

| | | | |
|---|---|---|---|
| 1,768,910 | 7/1930 | Ihrig | 252/50 |
| 2,198,961 | 4/1940 | Dietrich | 252/50 X |
| 2,214,443 | 9/1940 | Varteressian | 252/51 |
| 2,350,489 | 6/1944 | Beare | 252/37 |
| 2,458,526 | 1/1948 | Oberright | 252/51.5 R |
| 2,647,824 | 8/1953 | Jones et al. | 252/52 R |
| 2,672,447 | 3/1954 | Stewart et al. | 252/46.3 X |
| 2,672,448 | 3/1954 | Newnan et al. | 252/52 R X |
| 2,948,680 | 8/1960 | Fields | 252/32.7 |
| 3,062,612 | 11/1962 | Le Boucher | 252/390 X |
| 3,067,137 | 12/1962 | Schmulling | 252/50 |
| 3,135,632 | 6/1964 | Lucas et al. | 252/390 X |
| 3,247,111 | 4/1966 | Oberright et al. | 252/50 X |
| 3,346,496 | 10/1967 | Neumann et al. | 252/50 |
| 3,692,677 | 9/1972 | Stanton et al. | 252/51.5 R X |
| 3,951,833 | 4/1976 | Juda et al. | 252/51.5 R |

OTHER PUBLICATIONS

Desnos, Chem. Abstracts, vol. 46, 5827h, 1951.

Bartonicek et al., Chem. Abstracts, vol. 61, 524g, 1964.

*Primary Examiner*—Andrew Metz

*Attorney, Agent, or Firm*—Gary L. Wamer

[57] ABSTRACT

The lubricating characteristics of high temperature fluids used in Rankine Cycle and heat pump systems has been enhanced by incorporating therein heterocyclic arenes containing 8 to about 18 ring carbon atoms and an average of 1 to 2 ring nitrogen or S atoms per arene, and optionally 1 to 2 ring O atoms with substituents such as alkyl, amino, keto oxygen or hydroxyl groups.

4 Claims, No Drawings

METHOD OF IMPROVING ANTIWEAR PROPERTIES OF HIGH TEMPERATURE HYDROCARBON COMPOSITIONS

This application is a continuation of our prior U.S. application: Ser. No. 013,535 Filing Date Feb. 21, 1979 and now abandoned.

BACKGROUND OF THE INVENTION

This invention pertains to thermally-stable additives for high-temperature fluids and more particularly to additives which impart anti-corrosion and anti-wear properties of said fluids.

A wide variety of lubricants and heat transfer fluids are known in the art. These materials can be paraffinic/-naphthenic hydrocarbons, aromatic hydrocarbons containing one or more rings, silicones, fluorinated compounds, polyolefins, esters and the like. However, these fluids, in general, suffer from one or more difficiencies. Thus, for example, the paraffinic/naphthenic hydrocarbons are not thermally stable at or above 300° C. Lubricants and fluids used in Rankine Cycle and heat transfer systems should be stable in the range of about 325° to 375° C.

Although silicones are thermally stable, they are relatively expensive and tend to decompose in contact with aqueous alkaline media.

Fluorinated compounds are also often quite stable but are also quite expensive.

Esters hydrolyze in aqueous media thus severely limiting their use.

Aromatic hydrocarbons having two or three rings have been found to be thermally stable, but are often exposed to conditions where the need for additives having anti-wear and anti-corrosion properties are needed. It is therefore an object of this invention to provide such additives, which themselves, are adequately thermally stable in the lubricants or heat transfer liquids for which they are used, that is, at temperatures in the range of about 325° C. to about 375° C.

A wide variety of additives are known in the art for different purposes such as reducing the wear of metals which fluids contact, to minimize corrosion, minimize oxidation, to improve viscosity-temperature characteristics, to reduce pour point and the like. Such compounds include for example, triethylenetetramine and various imidazolines which are employed as corrosion inhibitors. However these and similar compounds decompose at about 200° C. Zinc dialkyl dithiophosphates and triarylphosphates, such as, tricresyl phosphate are extreme pressure anti-wear additives. However, these compounds are subject to hydrolysis in the presence of water and the zinc compounds decompose far below 300° C. Fatty acids and fatty acid soaps, as for example, sodium laurate, are lubricity additives but these lack the stability required for this invention.

The term "high-temperature fluids" as used in this invention include heat transfer fluids, as well as lubricants for Rankine Cycle systems.

Other objects will become apparent to those skilled in the art upon reading of the specification.

SUMMARY OF THE INVENTION

A method for improving the anti-wear and corrosion properties of high temperature fluid compositions has been devised which comprises adding about 0.001 to about 5% by weight of the total composition of at least one arene having 2 or more aromatic rings selected from the group consisting of:

(1) heterocyclic arenes containing at least 8 but no more than 18 ring carbon atoms, 1 to 2 ring N atoms per arene and 0 to 1 chalkogens selected from the group selected from O and S, per arene;

(2) heterocyclic arenes containing at least 8 but no more than 18 ring carbon atoms and 1 each ring S atom per arene;

(3) heterocyclic arenes from (1) and (2) above, containing 1 to 6 alkyl or alkoxy substituents having 1 to 18 carbons;

(4) heterocyclic arenes from (1) or (2) above, containing 1 or 2 carboxyl, amino, ether oxygen, keto oxygen, or hydroxyl substituents per aromatic ring;

(5) polycyclic aromatic compounds containing at least 10 but no more than 18 ring carbon atoms and 1 to 6 substituent keto oxygen and/or hydroxyl groups, with the proviso that no more than 2 such groups are present per aromatic ring;

(6) heterocyclic arenes from (1) above, having at least one ring substituted with a group selected from the class consisting of

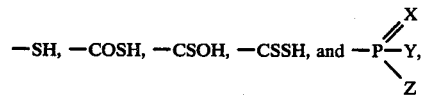

wherein X is S or O, Y is R or OR, where R is alkyl having 1 to 18 carbons, phenyl or tolyl, and Z is SH or OR;

(7) Ar—$(S)_x$—Ar wherein Ar is a monovalent radical derived from an arene in (1) above and x is an integer having values of 1 to 5; and (8) bipyridyl and bipyridyl derivatives containing 1 to 4 alkyl or alkoxy substituents having 1 to 18 carbon atoms.

Representative examples of the arenes in (1) above, include carbozole, purine, acridine, cinnoline (1,2-benzodiazine), quinoline, isoquinoline, quinoxaline (1,4-benzodiazine), quinazoline (1,3-benzodiazine), 1,10-phenanthroline, phenoxazine, thioxanthane, phenothiazine, 1,5-naphthyridine, 1,6-naphthyridine, 1,7-naphthyridine, 1,8-naphthyridine, and the like.

Representative examples of the arenes in (2) include thioxanthene, 1-thionaphthalene, and the like.

Representative examples of compounds in (3) of the arenes indicated above include 1-methylquinoline, 4-tertiarybutyl isoquinoline, 2-methylthionaphthalene, N-octylphenothiazine, and the like.

Representative examples of compounds in (4) above include 8-quinolinecarboxylic acid, quinaldic acid, quinomethionate, quininic acid, 4-hydroxyquinoline, 9-acidinamine, quinocide, trimeprazine, and the like.

Representative examples of compounds in (5) above include 2-methylquinizarin, 4-t-butylalizarin, alizarin, quinizarin, quinalizarin, alizarin blue, and the like.

Compounds representative of (6) above include 4-mercaptoquinoline, isoquinoline-4-dithiocarboxylic acid, 4-[di-(n-butyl)phosphorothiato]phenothiazine, 1-[2-ethylhexylphosphoro-dithiato]phenothiazine, 2-[di(-lauryl)phosphoro]phenothiazine, and the like.

Representative compounds of (7) above include 4,4'-diquinoline disulfide, 5,5'-diquinaldine polysulfide, and the like.

Representative compounds of (8) above include 1,1'-bipyridyl, 2,2'-bipyridyl, 3,3'-bipyridyl, 2-methyl-p-bipyridyl, 2,2'-dimethyl-p-bipyridyl, 3-t-butyl-o-bipyridyl, 3-methyl-3'-ethoxy-m-bipyridyl, and the like. The antiwear properties of the additives of this invention were evaluated in pump water tests using a Vickers V 104 vane pump rated at 5 gallons per minute (gpm) and directly coupled to a 10 hp 1200 rpm electric motor. Prior to each test, the hydraulic system was disassembled and mechanically cleaned and flushed with solvent. Then, 3,000 ml of fluid (containing impurities and additives) was poured into the reservoir, and its temperature was maintained at 140° F. (60° C.). During each test (which lasted for 40 hours) the fluid flowed from the reservoir to the inlet side of the pump, through the pump, across a pressure relief valve, through the tubes of a heat exchanger and then back to the reservoir. Pump speed was maintained at 1200 rpm and pump loading was 1,000 psig when testing a lubricant or 100 psig when testing a heat transfer fluid. Suitable pressure gauges, thermocouples and temperature-control devices were used to measure and maintain the desired conditions. Wear rates for both the pump, cam ring and vanes were used as a measure of fluid lubricity and anti-wear properties. New ring and vanes were used for each test.

Thermal stability-corrosion experiments were carried out in a rocking autoclave. When testing lubricants, 25 ml of the lubricant containing appropriate additives and 125 ml of 60 weight percent pyridine-40 wt.% water was placed in the autoclave. When testing heat transfer fluids, 50 ml of fluid, containing appropriate additives was placed in the autoclave. In all cases, a $1\frac{3}{8}'' \times 4'' \times 1/16''$ panel of 1008 plain carbon steel was also placed in the autoclave. The air was purged from the system with nitrogen, the final pressure being set at 10 psig. The system was then closed and heated at a specified temperature for 168 hours (one week). The vessel was then cooled to room temperature and the residual pressure reading taken. The 10 psi pressure due to nitrogen was substracted to obtain the reported value, resulting from the system itself. The vessel was then opened, and the steel panel was cleaned, dried and weighed to determine the corrosion rate.

The results of the pump wear tests are shown in Table I. In Rankine Cycle or heat pump systems, it is quite common for the working fluid to come into contact with and partially dissolve in the lubricant. Though the lubricant by itself may have excellent lubricity and anti-wear properties, the presence of dissolved working fluid usually results in excessive wear. This effect can be seen in tests A' through F' which are Controls using no additive. Even test E where a low amount of pyridine was used there is evidence of excessive wear as compared to test A' (Control). Observations as to the turbidity and color of the final fluid are also shown in Table I as evidence of decomposition in the working fluid system. Tests A through I show that quinizarin as well as acridine are effective in reducing wear in the presence of pyridine and water. Though all composition ranges for each additive were not tested, it appears that an additive concentration of up to about 0.5% is demonstrably effective in reducing wear and from this it may be inferred that additive concentrations as high as 1% or higher can be used.

Tests J through P demonstrate the use of additives containing no oxygen atoms but containing either one or two nitrogen atoms per molecule. These additives are more stable than the oxygen containing additives. Although useful, quinoxaline containing 2 nitrogen atoms in one ring is not as effective as quinoline. Thus, it appears most preferred for the additive to contain a single nitrogen atom in the ring rather than 2 nitrogen atoms where optimum anti-wear properties are necessary. Aromatic hydrocarbon molecules containing a single nitrogen atom are slightly more thermally stable than those containing two nitrogen atoms per molecule.

Tests Q and R show that totally aromatic hydrocarbon molecules can also be used but they are not as effective as additives containing polar atoms.

Tests S and T show that quinoline reduces pump wear on the heat transfer fluid in the absence of water or pyridine.

Table 2 contains data demonstrating the results of thermal stability tests. Quinizarin, although quite stable is not as stable as the base fluid nor as stable as the base fluid with other additives. Furthermore, although stability and corrosion are suitable at 300° C., the system is less stable at 350° C. or higher. Quinoline gives excellent corrosion protection at both 300° C. and 350° C. 2,2'-Bipyridyl, 1,10-phenanthroline and phthalazine all demonstrate excellent corrosion protection at 300° C. and 350° C.

The fluids used in the water, heat transfer and stability tests are identified below.

RCX-50 and HTFX-50 are both mixtures consisting of:

| | |
|---|---|
| Dibutylmethylnaphthalenes | 44% by weight |
| Methyltributylnaphthalenes | 28% by weight |
| Butylmethylnaphthalenes | 15% by weight |
| Butyldimethylnaphthalenes | 10% by weight |
| Butylnaphthalenes | 2% by weight |
| Mixture of naphthalene, benzene, tetralins, and biphenyls | 1% by weight |

RCX-144 is a distilled fraction of RCX-50 containing mainly dibutylmethylnaphthalenes and methyltributylnaphthalenes.

HTFX-2 is a distilled fraction of RCX-50 containing the remaining components left after removing the RCX-144 cut having a distillation range of about 250° C. to about 370° C. at atmospheric pressure.

TABLE 1

RESULTS OF PUMP, LUBRICANT AND HEAT TRANSFER FLUID WEAR TESTS

| | | | | Impurity | | | | | |
|---|---|---|---|---|---|---|---|---|---|
| | | Additive | | Wt. % | Wt. % | Pump Wear (mgs.) | | Final Fluid | |
| | Fluids | Name | Wt. % | Water | Pyridine | Cam Ring | Vanes | Turbidity | Color |
| Control A' | RCX-50 | — | — | — | — | 11 | 10 | S. | Lt. Br. |
| Control B' | RCX-50 | — | — | 5 | — | 811 | 760 | V. | — |
| Control C' | RCX-50 | — | — | 3 | 5 | 13,118 | 1,388 | V. | — |
| Control D' | RCX-50 | — | — | — | 3 | 26,585 | 1,605 | V. | — |
| Control E' | RCX-50 | — | — | — | 0.1 | 536 | 155 | V. | — |
| Test A | RCX-50 | Quinizarin | 0.01 | — | 0.1 | 131 | 34 | S. | — |
| Test B | RCX-50 | Quinizarin | 0.01 | — | 1.0 | 46.9 | 98.3 | — | — |

TABLE 1-continued

RESULTS OF PUMP, LUBRICANT AND HEAT TRANSFER FLUID WEAR TESTS

| | Fluids | Additive Name | Wt. % | Impurity Wt. % Water | Impurity Wt. % Pyridine | Pump Wear (mgs.) Cam Ring | Pump Wear (mgs.) Vanes | Final Fluid Turbidity | Final Fluid Color |
|---|---|---|---|---|---|---|---|---|---|
| Test C | RCX-50 | Quinizarin | 0.1 | — | 1.0 | 18.0 | 6.0 | C. | Lt. Br. |
| Test D | RCX-50 | Quinizarin | 0.5 | — | 1.0 | 232 | 10.6 | S. | Med. Br. |
| Test E | RCX-50 | Quinizarin | 0.1 | — | 3.0 | 126 | 126 | S. | Lt. Br. |
| Test F | RCX-50 | Quinizarin | 0.1 | 0.05 | 1.0 | 36.9 | 45.6 | C. | Med. Br. |
| Test G | RCX-50 | Quinizarin | 0.2 | — | 3.0 | 476 | 28.6 | C. | Med. Br. |
| Test H | RCX-144 | Quinizarin | 0.1 | — | 1.0 | 69.9 | 116 | S. | Dk. Br. |
| Test I | RCX-50 | Acridine | 0.1 | — | 1.0 | 230 | 157 | S. | Lt. Br. |
| Test J | RCX-50 | Isoquinoline | 0.1 | — | 1.0 | 37.7 | 139 | — | — |
| Test K | RCX-50 | Quinoxaline | 0.1 | — | 1.0 | 4,772 | 399 | V. | Dk. Br. |
| Test L | RCX-50 | Isoquinoline | 0.5 | — | 1.0 | 10.9 | 2.3 | C. | Lt. Br. |
| Test M | RCX-50 | Quinoline | 0.1 | — | 1.0 | 15.3 | 2.4 | C. | Lt. Br. |
| Test N | RCX-50 | Quinoline | 0.5 | — | 1.0 | 53.0 | 3.6 | S. | Lt. Br. |
| Test O | RCX-50 | Quinoline | 1.0 | — | 3.0 | 67.9 | 204 | C. | Lt. Br. |
| Test P | RCX-50 | Quinoline | 0.1 | — | 3.0 | 63.5 | 156 | C. | Lt. Br. |
| Test Q | RCX-50 | Phenanthrene | 0.1 | — | 1.0 | 1,727 | 210 | — | Lt. Br. |
| Test R | RCX-50 | Anthracene | 0.1 | — | 1.0 | 138 | 170 | — | Lt. Br. |
| Control F' | HTFX-50 | — | — | — | — | 4.8 | 1.7 | C. | V. Lt. Br. |
| Test S | HTFX-50 | Quinoline | 0.5 | — | — | 1.1 | 1.8 | C. | V. Lt. Br. |
| Test T | HTFX-50 | Quinoline | 1.0 | — | — | 1.8 | 2.2 | C. | V. Lt. Br. |

Clear = C.
Slightly turbid = S.
Very turbid = V.
Lt. Br. = Light Brown
Med. Br. = Medium Brown
Dk. Br. = Dark Brown
V. Lt. Br. = Very Light Brown

TABLE 2

RESULTS OF THERMAL STABILITY TESTS

| Test | Fluid | Temperature (°C.) | Additive Compound | Additive Wt. % In Fluid | Final Net Residual Pressure (psig) | Viscosities Temperature at (°F.) | Viscosities Before (Cs) | Viscosities After (Cs) | Viscosities Change (%) | Corrosion Rate on 1008 Steel (mils/yr) |
|---|---|---|---|---|---|---|---|---|---|---|
| 1 | HTFX-2 | 300 | — | — | 6 | 210 | 1.70 | 1.70 | — | 2.9 |
| 2 | " | 300 | Quinizarin | 0.25 | 6 | 210 | 1.70 | 1.70 | — | 1.9 |
| 3 | " | 350 | — | — | 49 | 210 | 1.70 | 1.80 | +6 | 2.6 |
| 4 | " | 350 | Quinizarin | 0.25 | 56 | 210 | 1.74 | 1.80 | +3 | 8.2 |
| 5 | RCX-50 | 350 | — | — | 22 | 100 | 50.0 | 47.6 | −4.8 | 1.2 |
| 6 | RCX-50 | 375 | — | — | 80 | 100 | 50.0 | 45.5 | −9 | 1.9 |
| 7 | " | 375 | Quinizarin | 0.25 | 143 | 210 | 4.25 | 3.60 | −15.3 | 3.0 |
| 8 | RCX-144 | 375 | Quinizarin | 0.25 | 190 | 210 | 6.99 | 13.64 | +95.1 | 1.9 |
| 9 | " | 372 | Quinoline | 0.25 | 170 | 210 | 6.96 | 12.03 | +72.8 | 1.9 |
| 10 | " | 350 | Quinoline | 0.25 | 20 | 210 | 6.95 | 7.13 | +2.6 | 1.4 |
| 11 | " | 350 | 2,2'-bipyridyl | 0.25 | 22 | 210 | 6.94 | 7.65 | +10.2 | 1.1 |
| 12 | " | 350 | 1,10-phenanthroline | 0.25 | 24 | 210 | 7.05 | 7.47 | +6.0 | 1.6 |
| 13 | " | 300 | Phthalazine | 0.25 | 1 | 210 | 6.94 | 7.21 | +3.9 | 1.1 |

Although the invention has been described in its preferred form with a certain degree of particularity, it is understood that the present disclosure has been made only by way of example and that numerous changes can be made without departing from the spirit and scope of the invention.

What is claimed is:

1. The method for improving the anti-wear properties of high temperature hydrocarbon composition which comprises adding to said compositions about 0.001 to about 5% by weight of the total composition of at least one arene having 2 or more aromatic rings, selected from the group consisting of acridine, quinoxaline, phthalazine and mixtures thereof.

2. Method claimed in claim 1 wherein the additive is acridine.

3. Method claimed in claim 1 wherein the additive is quinoxaline.

4. Method claimed in claim 1 wherein the additive is phthalazine.

* * * * *

UNITED STATES PATENT AND TRADEMARK OFFICE

CERTIFICATE OF CORRECTION

PATENT NO. : 4,346,015

DATED : August 24, 1982

INVENTOR(S) : George S. Somekh and Robert A. Cupper

It is certified that error appears in the above—identified patent and that said Letters Patent is hereby corrected as shown below:

Column 3, line 34, after the word"a", delete "1 2/3"" and substitute therefor --1 1/4"--.

Signed and Sealed this

*Second* Day of *November 1982*

[SEAL]

*Attest:*

GERALD J. MOSSINGHOFF

*Attesting Officer*

*Commissioner of Patents and Trademarks*